US005397652A

United States Patent [19]

Carey, II et al.

[11] Patent Number: 5,397,652

[45] Date of Patent: Mar. 14, 1995

[54] CORROSION RESISTANT, COLORED STAINLESS STEEL AND METHOD OF MAKING SAME

[75] Inventors: Jay F. Carey, II; Nicholas R. Hesske, both of Follansbee, W. Va.

[73] Assignee: The Louis Berkman Company, Steubenville, Ohio

[21] Appl. No.: 165,085

[22] Filed: Dec. 10, 1993

Related U.S. Application Data

[63] Continuation-in-part of Ser. No. 101, Jan. 4, 1993, abandoned, which is a continuation-in-part of Ser. No. 858,662, Mar. 27, 1992, Pat. No. 5,314,758.

[51] Int. Cl.[6] ..... B32B 15/18; C23C 22/72; C23C 22/78; C23C 22/83

[52] U.S. Cl. ..... 428/610; 428/648; 428/685; 148/242

[58] Field of Search ..... 428/648, 685, 939, 610, 428/632, 629; 420/557, 562; 427/433, 307, 329, 343; 148/242; 156/664

[56] References Cited

U.S. PATENT DOCUMENTS

| | | | |
|---|---|---|---|
| 84,205 | 11/1868 | Mills | 428/648 |
| 2,210,593 | 8/1940 | McCullough | 420/559 |
| 2,374,926 | 5/1945 | Fink | 117/51 |
| 2,533,048 | 12/1950 | Rodgers | 117/52 |
| 3,058,856 | 10/1962 | Miller | 148/16 |
| 3,105,022 | 9/1963 | Boggs | 205/226 |
| 3,331,230 | 7/1967 | Benz et al. | 72/42 |
| 4,015,950 | 4/1977 | Galland | 428/648 |
| 4,177,326 | 12/1979 | Windal et al. | 428/645 |
| 4,216,250 | 8/1980 | Nakayama et al. | 427/433 |
| 4,321,289 | 3/1982 | Bartsch | 427/287 |
| 4,758,407 | 7/1988 | Ballentine et al. | 420/561 |
| 4,778,733 | 10/1988 | Lubrano et al. | 428/675 |
| 4,806,309 | 2/1989 | Tulman | 420/562 |
| 4,879,096 | 11/1989 | Naton | 420/561 |
| 4,934,120 | 6/1990 | Boyd | 52/518 |
| 4,987,716 | 1/1991 | Boyd | 52/520 |
| 5,175,026 | 12/1992 | Bertol et al. | 427/307 |

FOREIGN PATENT DOCUMENTS

| | | | |
|---|---|---|---|
| 1457769 | 9/1966 | France . | |
| 2052324 | 3/1971 | France . | |
| 2281995 | 10/1974 | France . | |
| 2713196 | 10/1978 | Germany | 420/559 |
| 42-18219 | 9/1967 | Japan | 420/558 |
| 58-221283 | 12/1983 | Japan | 205/218 |
| 60-208465 | 10/1985 | Japan . | |
| 581604 | 11/1944 | United Kingdom . | |
| 796128 | 12/1956 | United Kingdom . | |
| 1277523 | 6/1972 | United Kingdom . | |
| 1513002 | 7/1975 | United Kingdom | C23C 1/06 |
| 1448662 | 9/1976 | United Kingdom . | |
| 1588808 | 9/1977 | United Kingdom | C22C 18/00 |
| 2099857 | 5/1982 | United Kingdom | C23C 1/02 |
| 2117414 | 2/1983 | United Kingdom | C23C 1/06 |

OTHER PUBLICATIONS

Standard Specification for Solder Metal, American Society for Testing & Materials, B 32–86, 1986, Table 5, pp. 1 & 9.

Soldering Manual, American Welding Society, N.Y., 1959, pp. 21–23.

Federal Specification No. QQ–T–201F, Nov. 1986, pp. 1–8.

The Making, Shaping & Treating of Steel, U.S. Steel Corporation, 1957, pp. 655–659, Sci. Lib. Coll. No. TN T30 C16, 1957.

Pickling of Iron & Steel, Metals Handbook, 9th Ed., vol. 5, American Society for Metals, 1982 pp. 68–82.

Hot Dip Tin Coating of Steel & Cast Iron, Metals Handbook, 9th Ed., vol. 5, American Society for Metals, 1982, pp. 351–355.

R. J. Nekeruis et al, Tinning of Steel, Metals Handbook, American Society for Metals, no date, pp. 709–712.

*Primary Examiner*—John Zimmerman

*Attorney, Agent, or Firm*—Vickers, Daniel & Young

[57] ABSTRACT

A colored, corrosion resistant architectural material having improved corrosion-resistant properties wherein the material includes stainless steel which is coated with a tin and the tin coated material is post-treated with an oxidizing solution to remove the tin coating to expose a barrier which includes an alloy of chromium, iron and tin. The barrier exhibits excellent corrosion resistance especially with respect to chlorine and has a dark grey or earth tone grey color.

23 Claims, 2 Drawing Sheets

CORROSION RESISTANT, COLORED STAINLESS STEEL AND METHOD OF MAKING SAME

This application is a continuation-in-part of prior application Ser. No. 000,101, filed Jan. 4, 1993, now abandoned, which is in turn a continuation-in-part of prior application Ser. No. 858,662, filed Mar. 27, 1992, now U.S. Pat. No. 5,314,758.

The present invention relates to the art of corrosion resistant stainless steel and more particularly to the process of continuously producing a strip of stainless steel with a colored protective barrier, which barrier is highly resistant to corrosion especially in a saline environment and has the consistent color of a weathered terne coated strip.

INCORPORATION BY REFERENCE

U.S. Pat. Nos. 4,987,716 and 4,934,120 illustrate metal roofing systems of the type to which this invention relates and are incorporated herein by reference.

BACKGROUND OF THE INVENTION

The present invention is particularly applicable for providing a colored, protective barrier on 304 or 316 stainless steel used for roofing material or other architectural material and it will be described with particular reference thereto; however, the invention has much broader applications and can be used for various stainless steel and various articles in strip form or otherwise. "Stainless steel" in the application means a large variety of alloy metals containing chromium and iron. The alloy may also contain nickel, carbon, molybdenum, silicon, manganese, titanium, boron, copper, aluminum, nitrogen and other various elements and compounds. For many years, roofing systems made of metal in various sheet gauge thicknesses have been used. Metals such as carbon steel and stainless steel are the most popular types of metal roofing systems. Carbon steel metal roofing systems are commonly treated with a corrosion-resistant coating to prevent rapid oxidation of the iron. One type of corrosion-resistant coating for carbon steel is a tin metal coating used in the food industry. Tin coating of carbon steel is normally carried out by a continuous, high-speed electrolysis process. In an electrolysis process, an electrical current is used to reduce alkaline or acidic electrolytes of tin to plate the tin on the carbon steel. The thickness of the tin coating ranges between $3.8\times10-4$ to $20.7\times10-4$ mm ($1.5\times10-5$–$8.15\times10-5$ in.). The equipment and materials used to electroplate carbon steel are very expensive and relatively complex to use; however, only a thin layer of tin is used so the cost of the expensive tin maintained is quite low. A less used process of coating carbon steel is by a hot dipping process. This process is normally not used because of the resulting minute areas of discontinuity in the tin coating. Consequently, the material is less satisfactory for food containers. In addition, hot dipped tin forms a thicker coating which is prone to flaking. Because tin is a material that is resistant to corrosion, materials highly susceptible to corrosion such as carbon steel can be coated with tin to produce highly corrosive-resistant products.

Many metallic alloys have been developed which have increased resistance to corrosion, such as stainless steel. Stainless steel is an alloy of iron and chromium and may include nickel and molybdenum and small amounts of other elements. The chromium within the stainless steel alloy is one of the primary components which inhibits corrosion. The chromium forms chromium oxide and tightly bonds to the surface of the stainless steel thus preventing oxygen from penetrating into the stainless steel to form corrosive ferrous oxides. Carbon steel has little if any chromium content, thus the iron readily oxidizes with the surrounding oxygen to form ferrous oxides commonly known as corrosion. Although stainless steel corrodes at a significantly slower rate than standard carbon steel, the stainless steel will eventually corrode and will corrode at a significantly faster rate than carbon steel coated with tin plate. Stainless steel is highly suceptable to corrosion in seawater where the salts really attack and corrode the stainless steel because of the chlorine in the environment.

Coating stainless steel with tin alloys by a hot-dipped process has been more successful. One of the most popular tin alloy coatings for carbon steel and stainless steel is a tin-lead alloy commonly known as terne. The composition of the terne alloy is generally about 80 weight percent lead and about 20 weight percent tin. The lead in the terne alloy readily bonds to both carbon steel and stainless steel to form a strong and durable lead-tin alloy coating. Although terne coated sheet metals have excellent corrosive-resistant properties and have been used in a wide variety of building applications such as roofing, terne coated materials have recently raised environmental concerns due to the lead content of the terne alloy. Even though the lead in the terne alloy is stabilized, there is some concern, albeit unfounded, about leaching of the lead from the terne alloy.

In U.S. application Ser. No. 000,101, a process for successfully coating stainless steel materials with tin containing little, if any, lead is disclosed. The tin coatings achievable are significantly thicker than thickness obtained by the electroplating process. Although the tin coating is more resistant to corrosion than stainless steel in a marine or saline environment, the tin still corrodes at an accelerated rate in such environments thus reducing the demand of tin coated products in such environments. Buildings located in costal regions throughout the world are subjected to a saline environment. Such regions must deal with above average rainfall and the saline environment resulting from the nearby seawater. The saline environment readily attacks metals such as iron and stainless steel thereby accelerating the corrosion rates. Structures that are located near or in the seawater may be directly attacked by the seawater thus exhibiting even higher accelerated corrosion. Very special and expensive alloys such as nickel-chromium and copper-nickel alloys have been developed which exhibit improved corrosion resistent properties in marine or saline environments. However, due to the costs associated with such special alloys, these alloys are not used for roofing materials. Furthermore, when using these various metal materials for architectural purposes, it is generally necessary to provide a dull weathered surface. Such surface coloring was normally caused by exposure to atmosphere; however, with the sulfur content in various locations differing, uniform color was not always guaranteed. When using stainless steel, precoloring has been attempted by electrolytic oxidation, by oxidation to change light refraction or by colored coatings. These processes are expensive and not very successful. Using many of these coloring processes, fingerprints often can discolor the surface.

Due to the lack of cost effective building materials that provide excellent corrosion resistance in a marine or saline environment and are properly colored, there has been a demand, especially from consumers located along or near costal regions, for building materials which are not cost prohibitive colored, and provide excellent corrosion resistance especially in marine or saline environments.

SUMMARY OF THE INVENTION

The present invention relates to the process of manufacturing a weather-resistant architectural material comprising stainless steel having a coating of tin which is post-treated with an oxidizing solution to form a unique barrier layer at the intermetallic layer on the stainless steel which barrier exhibits excellent corrosion resistance. Although the specially treated stainless steel is primarily used for architectural materials, such as for roofing materials and siding, the treated stainless steel can be used in a variety of applications for strip or cast articles.

In accordance with the principal feature of the present invention, there is provided a strip of stainless steel having a tin coating formed by hot dipping the stainless steel into molten tin, thereby forming a bonded tin coating with a desired thickness and an intermetallic layer made primarily of an alloy of chromium-iron-tin between the stainless steel and tin coating and post-treated with an oxidizing solution to remove the tin coating to expose the intermetallic alloy layer and form a unique barrier compound which barrier is believed to be a passivated alloy layer. This barrier exhibits excellent corrosion resistance. The type of stainless steel used is generally 304 or 316 stainless; however, other types of stainless steel may be used. The thickness of the stainless steel strip is generally not more than 0.03 in. thick and is typically 0.015 in. thick. Of course, this invention is applicable to any stainless steel surface. The stainless steel material is not limited to strip form. Stainless steel in strip form is desirable for use in a continuous process whereby the strip is unrolled and continuously travels through the various processes which form the unique colored barrier on the surface of the stainless steel strip. The stainless steel may be other architectural materials such as columns, beams, poles, etc. which cannot be continuously unwound from a roll. These materials usually are batch treated to obtain the colored protective barrier. Although the invention specifically relates to the forming of an alloy comprising chromium-iron-tin by treating stainless steel with a coating of tin, the invention includes the concept of initially making an alloy material comprising chromium-iron-tin which exhibits superior corrosion resistance. The alloy material can be treated with an oxidizing solution to passivate the alloy to further increase the corrosion resistance of the alloy and to also color the alloy.

The pre-treatment of the stainless steel includes cleaning the surface of the stainless steel of foreign debris and then aggressively pickling and/or chemically activating the stainless steel surface prior to the hot dipping of the stainless steel into the molten tin. The types of debris on the surface of the stainless steel includes soil, oil, paper, glue and other foreign materials. This debris can interfere with the aggressive pickling and/or chemical activation process which removes oxides from the stainless steel surface. The debris can be removed by subjecting the stainless steel surface to an abrasive and/or absorptive surface. The stainless steel surface can also be treated with cleaners or solvents to remove the debris.

The aggressive pickling process is designed to remove oxides from the stainless steel surface, The removal of oxides from the surface of the stainless steel is desirable before a proper intermetallic layer can be formed between the tin coating and stainless steel surface. Stainless steel contains primarily iron and chromium. The chromium on the stainless steel surface reacts with atmospheric oxygen to form chromium oxide which creates an almost impenetrable barrier between the iron within the stainless steel and the oxygen in the atmosphere. The chromium oxide film forms a very tight and strong bond with the stainless steel and is not easily removed. Although the formation of the chromium oxide film is important in the corrosion-resistant properties of the stainless steel, the chromium oxide film can interfere with the formation of the intermetallic layer when applying a coating of tin. The aggressive pickling process removes the chromium oxide from the stainless steel surface to allow the hot-dipped tin to combine with the oxide-free stainless steel surface to form the intermetallic layer. The pickling solution may contain various acids or combinations of acids such as hydrofluoric acid, sulfuric acid, nitric acid, hydrochloric acid, phosphoric acid and/or isobromic acid. Hydrochloric acid in combination with nitric acid can be used as the pickling solution to remove the chromium oxide from the stainless steel. In a hydrochloric-nitric acid pickling solution, the pickling solution contains about 5–25% hydrochloric acid and 1–15% nitric acid. The success of combining hydrochloric acid and nitric acid results in superior and rapid removal of chromium oxide from the stainless steel without causing detrimental pitting of the stainless steel surface. The temperature of the pickling solution is important so as to provide a highly active acid which will readily remove the chromium oxide from the stainless steel surface. The temperature of the pickling solution usually is between 120° to 140° F. For a hydrochloric-nitric acid solution, the temperature of the solution is usually about 80° F. The pickling solution may be agitated during the aggressive pickling process to prevent the pickling solution from stagnating and varying in concentration and to disperse gas pockets which may form on the stainless steel surface. The amount of time the stainless steel is treated in the pickling solution to adequately remove the chromium oxide without pitting the stainless steel surface is usually less than a minute.

The stainless steel, after aggressive pickling, is usually further treated by chemically activating the surface of the stainless steel to further remove oxides from the stainless steel surface. The chemical activation of the stainless steel includes the chemical treatment of the stainless steel with a deoxidizing agent to remove residual oxides which remain on the stainless steel surface. Various deoxidizing solutions may be used such as zinc chloride. The zinc chloride acts as both a deoxidizer and a protective coating for the stainless steel strip. The temperature of the zinc chloride solution is generally kept at ambient temperature (60°–90° F.) and agitated to maintain a uniform solution concentration. Small amounts of hydrochloric acid may also be added to the deoxidizing solution to further enhance oxide removal.

In accordance with yet another aspect of the tin coating procedure of the present invention, the stainless steel surface is maintained in a low oxygen environment until the tin coating is applied to the stainless steel surface. The maintenance of a low oxygen environment inhibits the formation of oxides on the stainless steel surface. The low oxygen environment may take on several forms such as a low oxygen-containing gas environment about the stainless steel or the immersion of the stainless steel in a low oxygen-containing liquid environment. Both these environments act as a shield to prevent oxides from forming. If a low oxygen gas environment is used, the gasses used to form the low oxygen-containing environment are typically nitrogen, hydrocarbons, hydrogen, noble gasses and/or other non-oxygen containing gasses. Generally, nitrogen gas is used to form the low oxygen gas environment. The low oxygen liquid environment normally consists of heated water having a low dissolved oxygen carton sprayed on the surfaces of the stainless steel; however, the stainless steel may also be immersed in the heated water. Generally, the temperature of the heated water is maintained above 100° F. and typically about 110° F. or greater.

In accordance with another aspect of the tin coating procedure of the present invention, there is provided a tinning tank which applies molten tin to the stainless steel surface. The tinning tank generally includes a flux box whereby the stainless steel passes through the flux box and into the molten tin. The flux box contains a flux which has a lower specific gravity than the molten tin, thus the flux floats on the surface of the molten tin. The flux acts as the final surface treatment of the stainless steel removing any residual oxides from the stainless steel surface and shielding the stainless steel surface from oxygen until the stainless steel is coated with tin. The flux can consist of zinc chloride and ammonium chloride. Such a flux solution contains approximately 30–60 weight percent zinc chloride and about 5–40 weight percent ammonium chloride; however, the concentrations of the two flux agents may be varied accordingly.

Once the stainless steel passes through the flux, the stainless steel enters into the molten tin. The temperature of the molten tin typically ranges between 575°–650° F. at the bottom of the tinning vat and may be over 100° cooler at the top of the tinning vat. The tin must be maintained above its melting point of 449° F. or improper coating will occur. Typically, the tin is maintained at a temperature of 590° F. During the tinning process, the molten tin bonds with the oxide-free stainless steel surface. At the point of bonding, an intermetallic layer is formed which assists in creating a strong bond between the stainless steel and tin coating. The intermetallic layer is believed to be formed by tin atoms molecularly intertwining with chromium and iron atoms in the stainless steel. The migration of tin into the surface layer of the stainless steel results in the formation of the intermetallic layer. As a result, the intermetallic layer is essentially a part of the stainless steel surface. As the tin coated stainless steel leaves the molten tin, the coated stainless steel passes between one or more sets of coating rollers which form a uniform thickness of the tin coating. The tin coating is maintained at a thin thickness of less than 0.002 inch. Thicker tin coatings can, however, be applied to the stainless steel surface. The tin coated stainless steel is an excellent corrosion resistant architectural material; however, it can corrode, albeit, slowly when exposed to a chlorine laden atmosphere.

In accordance with the basic concept of the present invention, the tin coated stainless steel is further treated with an oxidizing solution. The oxidizing solution reacts with the tin coating to remove the tin coating to expose the intermetallic layer of which reacts with the acid to provide a thin barrier that is highly resistant to corrosion, especially in a saline environment. The oxidation solution may further react with the intermetallic layer and color the layer. The oxidizing solution may include any of a number of acid solutions, neutral or alkaline solutions. The oxidizing solution usually contains nitric acid in a concentration of 5%–60% of the oxidizing solution. The oxidizing solution may also contain copper sulfate to enhance the removal of the tin layer. The copper sulfate may be added in amounts of up to 10% of the oxidizing solution. The temperature of the oxidizing solution is usually between 20°–80° C. The time for removing the tin coating to expose the intermetallic layer may be reduced by increasing the temperature of the oxidizing solution and/or increasing the strength of the oxidizing solution. The time to remove the tin coating is usually less than two minutes. Once the intermetallic layer is exposed, the strip is rinsed off to remove any remaining oxidizing solution on the strip leaving the protective barrier over the intermetallic layer. The concept of removing a tin layer from tin coated stainless steel is novel to the art, especially in light of the fact that the tin coating was initially applied to improve the corrosion resistance of the stainless steel.

The primary object of the present invention is the provision of a weather-resistant stainless steel article having a colored surface which is highly resistant to corrosion.

Another object is the provision of a method of forming a colored protective barrier on the exposed surface of a stainless steel article.

Still a further object of the present invention is a method of providing a protective, colored layer on the surface of a chromium and iron alloy by first applying a thin layer of tin, preferably hot-dipped, removing the tin with an oxidizing solution by an auto-catalytically controlled action to expose the protective layer of iron-tin alloy and finally to color and/or passivate such protective layer.

Yet another object of the present invention is the provision of applying molten tin to the oxide-free surface of the stainless steel to form an intermetallic layer on the surface of the stainless steel, which layer is exposed and treated to provide a protective barrier.

Another object of the present invention is the provision of a method of providing an article with an intermetallic layer containing chromium-iron-tin and having a protective, colored surface, which method removes excess tin and passivates the layer.

Yet another object of the present invention is a metal with a pre-colored surface which is consistent and quite similar to weathered terns coated strip without any lead.

Another object of the present invention is the provision of subjecting a hot-dipped tin coated stainless steel to an oxidizing solution to remove the tin coating from the stainless steel and expose the corrosion resistant intermetallic layer.

Still a further object of the present invention is the provision of producing a highly corrosion resistant material that is economical to make by a continuous process.

These and other objects and advantages will become apparent to those skilled in the art upon reading the following description taken together with the accompanying drawings.

DESCRIPTION OF THE PREFERRED EMBODIMENT

Figure 1:
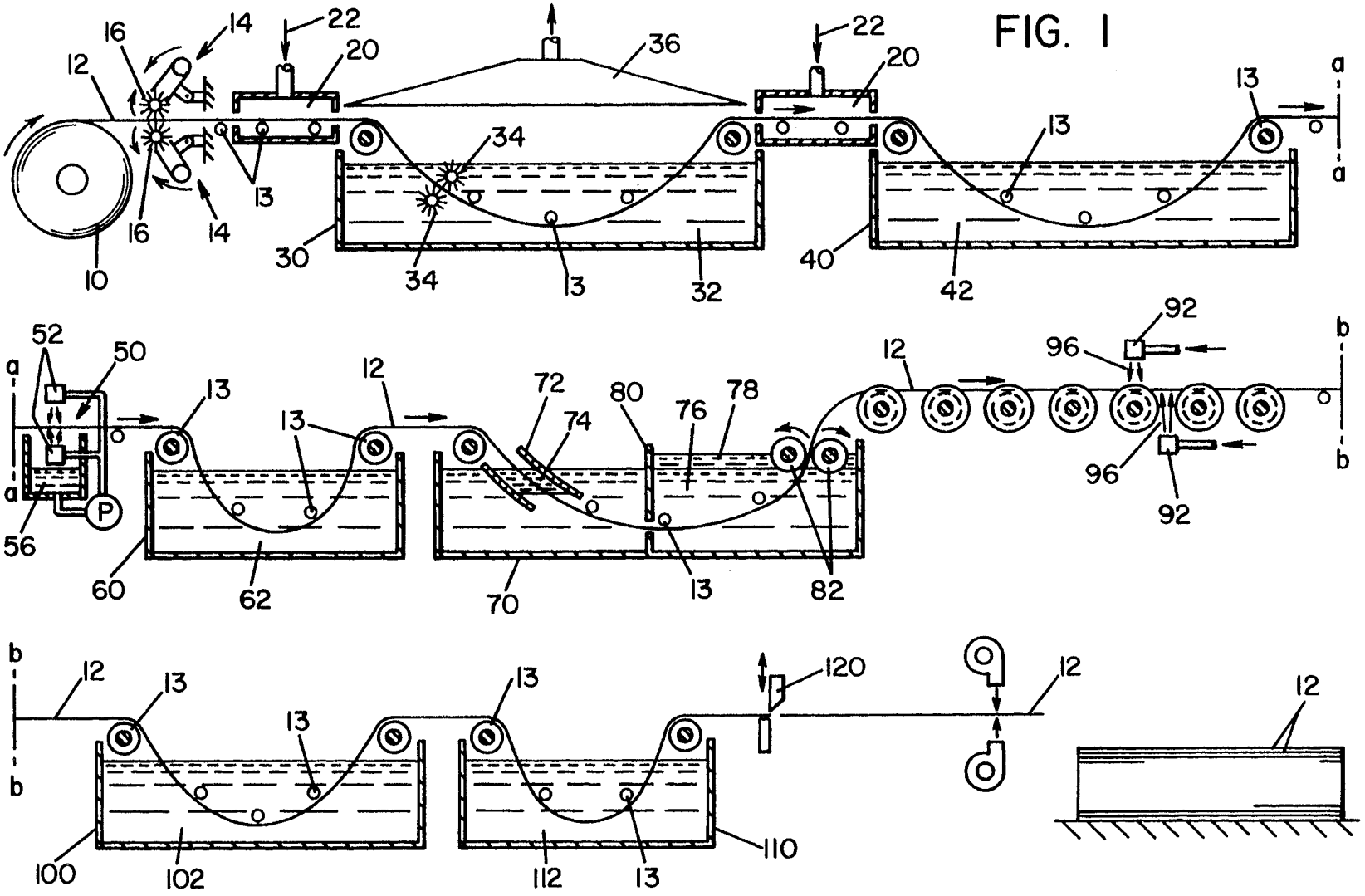
FIG. 1 is a cross-sectional view of the complete process for making stainless steel with an intermetallic surface layer of the present invention.

Referring now to the drawings, wherein the showings are for the purpose of illustrating preferred embodiments of the invention only and not for the purpose of limiting the same, reference is first made to FIG. 1 which illustrates the complete novel continuous process for forming an intermetallic layer of on the stainless steel strip surface. Stainless steel strip 12 enters the process from stainless steel roll 10. The stainless steel used may be 304 type stainless steel, which contains about 18 percent chromium and about 8 percent nickel. However, other types of stainless steel can be used. The thickness of stainless steel strip 12 is about 0.015 in. thick; however, stainless steel strip 12 may be thinner or thicker. Stainless steel strip 12 is generally unwound from stainless steel roll 10 at speeds which are usually less than 150 ft./min. and preferably between 70 to 100 ft./min. Strip guides 13 are positioned throughout the process to properly guide stainless steel strip 12 through each treatment sector.

As strip 12 leaves roll 10, strip 12 encounters the abrasion treater 14. Abrasion treater 14, in the form of wire brushes 16, is driven by a motor. The wire brushes are placed in contact with stainless steel strip 12 to remove foreign debris from stainless steel strip 12 and to initially etch and/or mechanically remove chromium oxide from the surface of stainless steel strip 12. Abrasion treater 14 is preferably biased against stainless steel strip 12 to provide the necessary friction between the brushes 16 and stainless steel strip 12 for proper cleaning of stainless steel strip 12. Preferably an abrasion treater 14 located on the top and bottom surface of stainless steel strip 12 so that proper treatment of stainless steel strip 12 is achieved. Abrasion brush 16 is typically made of a metallic material having a hardness greater than stainless steel strip 12 so that abrasion brush 16 will not quickly wear down and can properly remove foreign materials. Preferably, abrasion brush 16 rotates in an opposite direction relative to the moving stainless steel strip 12 to provide additional abrasion to the stainless steel strip 12.

Although not shown, strip 12 may be further treated before or after abrasion treater 14 with an alkaline cleaner or an organic solvent to remove foreign objects on the surface of strip 12.

Once stainless steel strip 12 passes through abrasion treater 14, strip 12 preferably enters low oxygen gas environment 20. Low oxygen gas environment 20 is formed by surrounding the stainless steel strip 12 with low oxygen-containing gas 22. Preferably, the low oxygen-containing gas 22 is essentially of nitrogen gas. The nitrogen gas surrounding the stainless steel strip 12 acting as a barrier against oxygen in the atmosphere and to prevent the oxygen from reacting with chromium and iron in strip 12.

Stainless steel strip 12 after leaving low oxygen gas environment 20 enters into pickling tank 30. Pickling tank 30 is generally about 25 feet in length and of sufficient depth to completely immerse stainless steel strip 12 in pickling solution 32. Pickling solution 32 preferably consists of a hydrochloric acid-nitric acid solution. Preferably, the hydrochloric-nitric acid concentration within pickling solution 32 is about 10% hydrochloric acid and 3% nitric acid. Pickling solution 32 is preferably maintained at a temperature between 128°–133° F. so that pickling solution 32 is in a high reactive state to remove chromium oxide from the surface of strip 12. Pickling tank 30 preferably contains at least one agitator 34 to agitate pickling solution 32 thereby maintaining a uniform solution concentration, a uniform solution temperature and to break up any gas pockets which may form on strip 12. A pickling solution vent 36 is preferably placed above pickling tank 30 to collect and remove acid fumes and other gasses escaping from pickling tank 30. Strip 12 usually enters a low oxygen gas environment 20 after exiting pickling tank 30.

Pickling solution 32 remaining on strip 12 is removed in rinse tank 40. Rinse tank 40 contains a rinse solution 42 which is preferably water. The water in rinse tank 40 is deoxygenated by heating the water to above 100° and preferably about 110° F. Due to the slightly acidic properties of rinse solution 42, rinse solution 42 may remove small amounts of oxides which may still exist on the surface of strip 12. Rinse solution 42 is usually agitated so as to facilitate the removal of pickling solution 32 from strip 12.

After stainless steel strip 12 leaves rinse tank 40, strip 12 preferably enters a low oxygen liquid environment 50. Low oxygen liquid environment 50 includes at least one spray jet 52. Spray jet 52 injects a low oxygen-containing liquid 56 on the surface of stainless steel strip 12 to prevent oxygen from reacting with the chromium and/or iron on the surface of strip 12 and remove any additional pickling solution 32 which may be present on strip 12 after exiting rinse tank 40. Low oxygen-containing liquid 56 is heated water having a temperature of about 110° F.

Stainless steel strip 12, upon leaving low oxygen liquid environment 50, preferably enters chemical activating tank 60. Chemical activating tank 60 contains a chemical activating solution 62, which further removes any oxides remaining on the surface of strip 12. Usually, chemical activating solution 62 is a zinc chloride solution maintained at a temperature between 80°–90° F. The zinc chloride within chemical activating tank 60 not only removes lingering oxides on strip 12, but the zinc chloride acts as a protective coating to prevent oxide formation on strip 12 until stainless steel strip 12 enters tinning tank 70. Chemical activating tank 60 may contain an agitator to assist in oxide removal and prevent stagnation of solution 62.

Figure 2:
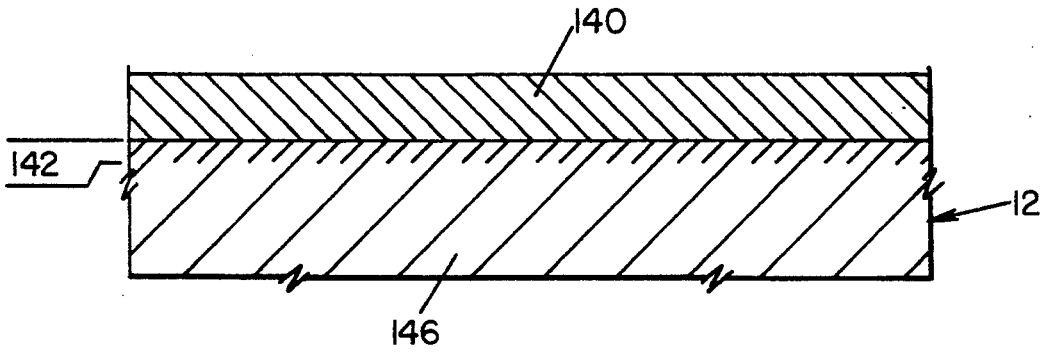
FIG. 2 is a cross-sectional view of a tin coated stainless steel strip which illustrates the intermetallic layer.

Prior to strip 12 being coated with molten tin 76, strip 12 enters flux box 72 located in tinning tank 70. Flux box 72 contains a flux 74 having a specific gravity less than molten tin 76. Flux 74 preferably consists of a zinc chloride and ammonia chloride solution. Preferably, flux 74 contains about 50% zinc chloride and about 8% ammonia chloride. Flux 74 removes any remaining oxides on the surface of strip 12. Upon leaving flux box 72, stainless steel strip 12 enters molten tin 76. Molten tin 76 in tinning tank 70 is maintained at a temperature above 449° F. and preferably at a temperature of about 590° F. Tinning tank 70 is preferably divided into two chambers by palm oil barrier 80 so as to prevent palm oil 78 from spreading over the total surface of molten tin 76 in tinning tank 70. Molten tin 76 contains primary tin and may contain minor amounts of other metals, such as zinc, iron, copper, etc. The tin content is preferably greater than 95 weight percent. The lead content of molten tin 76 is less than 0.1 weight percent and preferably less than 0.01 weight percent. As strip 12 passes through molten tin 76, the tin atoms penetrates and/or reacts with the oxide-free surface of strip 12 to form a very thin intermetallic layer 142 which exists between tin coating 140 and the stainless steel body 146, as illustrated in FIG. 2. Although the exact composition of the intermetallic layer is not certain, intermetallic layer 142 is believed to be a molecular level alloy primarily of chromium, iron and tin Cr—Fe—Sn. However, intermetallic layer 142 may contain nickel and small amounts of other elements or compounds. Intermetallic layer 142 can be thought of as a transition layer between body 146 and tin coating 140. Intermetallic layer 142 may also contain hydrogen, nitrogen and oxygen; however, the exact formulation is not yet known. Intermetallic layer 142 is believed to be responsible for the strong bonding between tin coating 140 and stainless steel body of strip 12. Prior to exiting the tinning tank 70, strip 12 passes between at least one set of coating rollers 82. Coating rollers 82 maintain the desired tin coating thickness on strip 12. The thickness of the tin coating on strip 12 is usually less than 0.002 inch and is preferably about 0.00075 inch.

Palm oil 78 is preferably located near coating rollers 82. Palm oil floats on top of molten tin 76 to prevent the tin from solidifying and oxidizing and also aids in properly distributing the tin on stainless steel strip 12.

Metal coating jets which injects molten tin on the outer surface of coating roller 82 may be installed to spray molten tin 76 on coating roller 82 as strip 12 travels between coating roller 82 thereby filling in any small surface areas on strip 12 which have not been coated by molten tin 76 in tinning tank 70.

After strip 12 exits tinning tank 70, the tin coating is cooled by cooling water 96 by at least one cool water jet sprayer 92 and/or in a cooling tank, which is not shown. Cooling water 96 is generally maintained at ambient temperatures. As explained, the coated tin surface stainless steel is shown in FIG. 2 where the tin layer 140 is on strip 12 and forms the intermetallic alloy layer 142 on the stainless steel surface 146.

Figure 3:
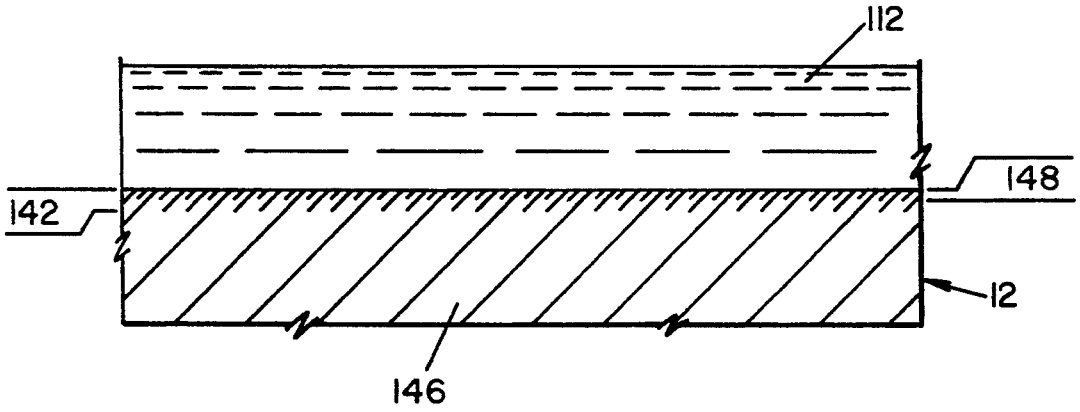
FIG. 3 is a cross-sectional view of the stainless steel strip submerged in the oxidizing solution.

Once the tin coating is cooled, strip 12 proceeds to the oxidizing tank 100. Oxidizing tank 100 contains an oxidizing solution 102 which removes tin coating 140 from strip 12 to expose intermetallic layer 142 as illustrated in FIG. 3. Oxidizing solution 102 is also believed to react with intermetallic layer 142 and form a barrier 148 at the upper portion of alloy 142. The barrier has been tested and proves to be vastly superior in protecting the stainless steel strip 12. Oxidizing solution 102 also can color intermetallic layer 142. Oxidizing solution 102 is preferably a solution of nitric acid. The nitric acid concentration can be between 5%–60% and is preferably about 20%. By increasing the concentration of the nitric acid, the time to remove tin coating 140 is shortened. Usually, the removal of tin coating 140 is less than two minutes. Copper sulfate may be added to the nitric acid to further increase the rate of removal of tin coating 140. Copper sulfate, if present, is usually added at a concentration of less than 10% and preferably 1% of oxidizing solution 102. The temperature of oxidizing solution 102 must be maintained at a temperature that provides sufficient activity to the oxidizing solution 102. The temperature usually is maintained between 30°–80° C. and preferably about 50° C. By increasing the temperature, the activity of oxidizing solution 102 increases thereby shortening the time needed to remove tin coating 140 from strip 12. Oxidizing tank 100 may also contain an agitator to prevent stagnation and/or vast concentration differences of oxidizing solution 102 in tank 100 and to prevent gas bubbles from forming on the surface of strip 12.

After strip 12 passes through oxidizing tank 100, strip 12 proceeds into oxidizing rinse tank 110. Rinse tank 110 contains a liquid 112 which removes any remaining oxidizing solution 102 from strip 12. Preferably, liquid 112 is water at ambient temperature. Rinse tank 110 may contain an agitator to further assist in the removal of oxidizing solution 102 from strip 12. Although not shown, strip 12 may be rinsed off by spray jets instead of in rinse tank 110. The spray jets direct a liquid to strip 12 to remove oxidizing solution 102 from strip 12. The spray jets would be a similar design as spray jets 92.

Strip 12, after being rinsed in rinse tank 110, is preferably subjected to a leveler which is not shown. The leveler preferably includes 17 level rollers which produce a uniform and smooth surface on strip 12. After stainless steel strip 12 exits the leveler, strip 12 is cut by shear 120 into the desired strip lengths.

Barrier 148 on intermetallic layer 142 of strip 12 has been found to be surprisingly resistant to corrosion, especially in saline environments. Although the inventor does not wish to be held to any one theory as to why barrier 148 exhibits increased corrosion resistance, the inventor believes the unique alloying structure of Cr—Fe—Sn in layer 142 and its reaction to the oxidizing solution 102 produces a compound that is so stable that it resists reacting with ions in a saline solution. Nickel may also be a component of intermetallic layer 142 especially in stainless steel which contains nickel. Other elements such as nitrogen, hydrogen, oxygen may also be present in barrier 148 to enhance the stability of the intermediate layer with the upper barrier, which appears to be microscopic in thickness. During the oxidizing and/or rinse procedure the unique intermetallic layer 142 may oxidize with the available surrounding oxygen to form the corrosion resistant barrier 148 and color intermetallic layer 142. The inventor believes it is a combination of the special make up of the intermetallic layer in combination with a protective oxide layer or barrier 148 that provides for the surprising superior corrosion resistance, especially in a saline environment. The inventor has also found that not only is intermetallic layer barrier 148 corrosion resistant, intermetallic layer 142 with its upper barrier 148 is malleable and will not crack when formed into various shapes for roofing materials. Barrier 148 can be colored with oxidizing solution 102 to form a dark grey or earth tone grey, non-reflective surface. The non-reflective surface is beneficial for use on buildings that require low reflective materials, such as buildings near airports. The absence of lead from intermetallic layer 142 and barrier 148 makes strip 12 a superior substitute to terne coated materials. Not only is the corrosion resistance of intermetallic layer 142 and barrier 148 greater than terne coatings, especially in saline environments, intermetallic layer 142 contains no lead or essentially no lead thereby alleviating any concerns associated with the use of lead materials. Intermetallic layer 142 with barrier 148 has also been found to be resistant to scratching thereby improving the visual quality of strip 12 and enhancing the damage resistance of strip 12.

The following example illustrates the improved corrosion resistance of strip 12 with barrier 148 in a saline environment. Stainless steel type 304 was aggressively pickled, chemically activated and coated with 0.00075 inch of tin. The coated stainless steel was then treated with an oxidizing solution containing 20% nitric acid and 1% copper sulfate. The temperature of the oxidizing acid was 50° C. and the time of treatment was about 20 seconds to expose the intermetallic layer. The exposed surface was a dark grey or earth tone grey, similar in color to weathered terne coated stainless steel in a sulfur atmosphere. The treated stainless steel was then compared with stainless steel type 316 and terne coated (80% lead–20% tin) stainless steel type 304 to determine the relative corrosion resistance in a saline solution of 5% chlorine. The results are as follows:

TABLE 1

| Material | Period of Exposure (Months) | Comments |
|---|---|---|
| Stainless 304 with Intermetallic Layer 142 and Protective Barrier 148 | 6 | No corrosion evident. Surface appears the same as when it was first put into the saline solution. |
| Stainless Steel Type 316 | 6 | Corrosion apparent. Pitting of the surface beginning. |
| Terne Coated Stainless Steel Type 304 | 6 | Terne coating has been almost completely removed. Stainless steel surface beginning to corrode and pit. |

As is evident from Table 1 above, the stainless steel with intermetallic layer 142 and protective barrier 148 of the present invention exhibited superior corrosion resistance to standard stainless steel type 316 and terne coated stainless steel.

It has been found that an oxidizing solution of only 20% nitric acid is sufficient to remove tin coating 140 to expose intermetallic layer 140. In addition, the nitric acid can passivate intermetallic layer 142 to a dark grey color, or earth tone grey, in about 20 seconds. The 20 second oxidizing treatment removes tin coating 140 to intermetallic layer 142, but does not remove intermetallic layer 142; consequently, irregularities in the tin thickness are compensated for by an auto-catalytic control of the tin removal process. The color of the colored intermetallic layer 142 is similar to weathered terne coated steel; however, layer 142 does not contain any lead, except for a possible trace amount. Intermetallic layer 142 is believed to be an iron, chromium and tin alloy; thus, any ferrous alloy with chromium could be treated to for intermetallic layer 142 when coated with hot lead, either by a hot dip process, air knife process or by a furnace heating process that melts the electrolytically deposited tin and causes it, in molten condition, to flow over the stainless steel surface. Resulting intermetallic layer 142, after the tin is removed by an oxidizing solution, is believed to expose layer 142 to provide a strong corrosion resistant barrier. Oxidizing solution 102 then passivates layer 142 to create barrier 148 and to also provide the desired color to barrier 148.

Fingerprints do not cause discoloration of the surface of barrier 148. It has been found that a better uniformity in color is obtained when tin coating 140 is degreased with a solvent or alkaline solution prior to subjecting tin coating 140 to oxidizing solution 102; however, this degreasing does not have affect on the actual process. The removal of tin coating 140 stops automatically at intermetallic layer 142 which is then passivated to form barrier 148 and a consistent color. Copper sulfate is an optional additive to the nitric acid. In oxidizing solution 102, tin nitrate accumulates and can be later used to reclaim the tin. The thickness of tin coating 140 is not critical as long as it is heated to a molten state to form intermetallic layer 142 at the stainless steel surface. Since tin is expensive, thinner coatings are desired.

The invention involves coating of stainless steel with hot tin and then removing the excess tin to expose only the intermetallic layer 142 on the surface of the stainless steel.

The invention has been described with reference to a preferred embodiment and alternates thereof. It is believed that many modifications and alterations to the embodiment discussed herein will readily suggest themselves to those skilled in the art upon reading and understanding the detailed description of the invention. It is intended to include all such modifications and alterations in so far as they come within the scope of the present invention.

We claim:

1. A corrosion resistant architectural material exhibiting excellent corrosion resistance comprising a stainless steel strip having an intermetallic surface layer formed by passing said stainless steel strip through a bath of molten tin at a temperature greater than 449° F. at a speed of less than 150 ft/min to produce a tin layer of less than 0.002 inch over said intermetallic surface layer and removing said tin coating from the surface of said stainless steel strip to expose said intermetallic layer with an oxidizing solution.

2. A method of providing a colored protective layer on a ferrous strip surface by a continuous process, said method comprising the steps of:

(a) pre-treating said ferrous strip for removing oxides from the surface of said strip;

(b) providing a tin coating of less than about 0.002 inch thickness on said surface to create an intermetallic alloy layer between said strip surface and said tin coating, said alloy layer containing chromium, tin and iron, said tin coating provided by passing said strip at less than 150 ft/min through a molten bath of tin which is maintained at a temperature of at least 449° F.;

(c) cooling said tin coated ferrous strip;

(d) removing said tin coating with an oxidizing solution to expose said intermetallic layer.

3. A method as defined in claim 2, wherein said tin coating is less than 0.001 inch.

4. A method as defined in claim 2, wherein said intermetallic alloy includes iron, chromium and tin.

5. A method as defined in claim 2, wherein said intermetallic layer includes nickel.

6. A method as defined in claim 4, wherein said intermetallic layer includes nickel.

7. A method as defined in claim 2, wherein time of treatment with said oxidizing solution is less than about two minutes.

8. A method as defined in claim 2, wherein said oxidizing solution contains at least 5% nitric acid.

9. A method as defined in claim 8, wherein said oxidizing solution contains less than 60% nitric acid.

10. A method as defined in claim 2, wherein said oxidizing solution includes copper sulfate.

11. A method as defined in claim 8, wherein said oxidizing solution includes copper sulfate.

12. A method as defined in claim 11, wherein said oxidizing solution contains less than 10% copper sulfate.

13. A method as defined in claim 2, wherein the temperature of said oxidizing solution is between 30°–80° C.

14. A method as defined in claim 12, wherein the temperature of said oxidizing solution is between 30°–80° C.

15. A method as defined in claim 2, wherein said strip is a stainless steel strip.

16. A method as defined in claim 15, wherein said stainless steel strip has a thickness of less than 0.03 inch.

17. A method as defined in claim 16, wherein said speed of said strip is at least about 70 ft/min.

18. A method as defined in claim 2, including the additional step of pre-treating said stainless steel to remove oxides from the stainless steel surface prior to applying said tin layer.

19. A method as defined in claim 18, wherein said pretreating includes aggressively pickling said stainless steel surface.

20. A method as defined in claim 18, wherein said pretreating includes chemically activating said stainless steel surface.

21. A method as defined in claim 18, wherein said stainless steel surface is maintained within a low oxygen environment until said tin coating is applied to said surface.

22. A method as defined in claim 2, including the step of passivating said exposed protective layer to provide an exposed colored surface.

23. A method as defined in claim 22, wherein said passivating includes the application of a nitrogen based acid solution to the surface of said exposed protective layer.

* * * * *

UNITED STATES PATENT AND TRADEMARK OFFICE

CERTIFICATE OF CORRECTION

PATENT NO. : 5,397,652
DATED : March 14, 1995
INVENTOR(S) : Carey, II et al.

It is certified that error appears in the above-identified patent and that said Letters Patent is hereby corrected as shown below:

Title page,
Item [63], delete and substitute therefor -- Continuation-in-part of Ser. No. )8/000,010, Jan.4, 1993,abandoned, which is a continuation-in-part of Ser. No. 07/ 858,662, Mar. 27, 1992, Pat. No. 5,314,758.

Continuation-in-part of Ser. No. 08/000,010, Jan. 4, 1993, abandoned, which is a continuation-in-part of Ser. No. 07/913, 209, Jul. 15, 1992, abandoned, which is a continuation-in-part or Ser. No. 07/858,662, Mar. 27, 1992, Pat. No. 5,314,758. --

Column 1,
Line 9, of the specification after "5,314,758." add the following:

-- This application is also a continuation-in-part of U.S. patent application Ser. No. 08/000,010, filed Jan 4, 1993, now abandoned, which in turn is a continuation-in-part of U.S. patent application Ser. No. 07/913,209, filed July 15, 1992, now abandoned, which in turn is a continuation-in-part of U.S. patent application Ser. No. 07/858,662 filed March 27, 1992, Now U.S. Patent No. 5,314,758. --

Signed and Sealed this

Seventeenth Day of September, 2002

*Attest:*

*Attesting Officer*

JAMES E. ROGAN
*Director of the United States Patent and Trademark Office*